United States Patent [19]

Iwata

[11] Patent Number: 4,869,609

[45] Date of Patent: Sep. 26, 1989

[54] METHOD OF CONTROLLING PRINTING POSITIONS IN A PRINTER AND AN APPARATUS THEREFOR

[75] Inventor: Masaji Iwata, Tokorozawa, Japan

[73] Assignee: Citizen Watch Co., Ltd., Tokyo, Japan

[21] Appl. No.: 252,552

[22] Filed: Oct. 3, 1988

[30] Foreign Application Priority Data

Oct. 1, 1987 [JP] Japan ..... 62-245790

[51] Int. Cl.[4] ..... B41J 3/12

[52] U.S. Cl. ..... 400/323; 400/121; 400/279; 400/322

[58] Field of Search ..... 400/323, 279, 121, 320, 400/322; 307/518

[56] References Cited

U.S. PATENT DOCUMENTS

| | | | |
|---|---|---|---|
| 4,208,137 | 6/1980 | Liu | 400/323 |
| 4,284,362 | 8/1981 | Jackson | 400/323 |
| 4,343,012 | 8/1982 | Knapp | 400/323 |
| 4,603,984 | 8/1986 | Ullenboom | 400/323 |
| 4,710,653 | 12/1987 | Yee | 307/518 |

*Primary Examiner*—Paul T. Sewell
*Assistant Examiner*—Steven S. Kelley
*Attorney, Agent, or Firm*—Lowe, Price, Leblanc, Becker & Shur

[57] ABSTRACT

Upon supply of electric power to a printer, a dot pulse is generated from a dot pulse generator each time a carriage driving motor rotates for a predetermined rotational angle, and thereafter, an output of a home position sensor falls when a carriage reaches its reference moving position. When a microprocessor determines that the leading edge of a dot pulse, generated for the first time after the generation of the trailing edge of the sensor output, is undetectable due to the presence of a closed timing relationship between the trailing edge of the sensor output and the leading edge of the dot pulse, on the basis of one period of the pulse generator output and a time period from an instant at which the trailing edge of the sensor output is generated to an instant at which the leading edge is detected, the microprocessor supplies a high level signal to an exclusive OR circuit, connected to the pulse generator, so as to invert the polarity of the detection edge of the dot pulses, to thereby prevent the closed timing relationship so as to prevent the leading edge of the dot pulse from being undetected, whereby a variation in printing positions is reduced.

17 Claims, 5 Drawing Sheets

METHOD OF CONTROLLING PRINTING POSITIONS IN A PRINTER AND AN APPARATUS THEREFOR

BACKGROUND OF THE INVENTION

The present invention relates to a printer, and more particularly, to a method of controlling printing positions in a serial printer of a type adapted for bi-directional printing, which method is capable of preventing or reducing dislocation of printing positions, and an apparatus therefor.

Generally, a serial printer comprises a home position sensor for printing position control, which is arranged to generate an output signal when a carriage driven by a motor reaches one end of a printing area. In synchronism with the fall of this output signal occurring upon the carriage reaching its reference moving position, an operation for counting dot pulses is started so as to control printing positions on the basis of the count, each dot pulse being generated each time the carriage driving motor rotates for a predetermined rotational angle. Ordinarily, the counting operation is carried out in synchronism with generation of a detection edge of the dot pulse, which is comprised of either one of the leading (rising) and trailing (falling) edges of the pulse.

However, the generation timing of the detection edge of the dot pulse can vary due to vibration of a drive belt or a pulley shaft of a carriage driving mechanism, for instance. In this respect, in case that the trailing edge of the output signal supplied from the home position sensor, which may be used as a trigger signal for causing the dot pulse counting operation to start, is generated in a closed timing relation with the generation of the detection edge of the dot pulse, the detection edge of the dot pulse to be counted can be generated just before the fall of the sensor output despite the requirement that such detection edge should be generated after the fall of the sensor output. As a result of this kind of fluctuation in generation timing of the detection edge with respect to the fall of the sensor output, the detection edge of the dot pulse to be counted is counted or is not counted, resulting in an uncontrollable dislocation of printing positions.

For instance, let it be assumed that a regular printing section of a serial printer of a type adapted for reciprocal or bi-directional printing starts at a point of P1 and ends at a point Q1 (see FIG. 6(*c*)), the count i of dot pulses, indicative of the printing start position in the forward movement of the carriage, and the count m, indicative of the printing end position in the backward movement, are set to values corresponding to the point of P1, respectively. Further, the count i, indicative of the end position in the forward movement, and the count k, indicative of the start position in the backward movement, are set to values corresponding to the point of Q1, respectively (see FIG. 6(*a*)). If the dot pulse to be counted immediately after generation of the trailing edge of the home position sensor output is not counted due to an uncontrollable shift of generation timing thereof, for instance, the respective counts of dot pulses at the position of P1 in the forward and backward movements of the carriage equal to $i-1$ and $m-1$; and the respective counts at the position of Q1 equal to $j-1$ and $k-1$ (see FIG. 6(*b*)). As a result, the printing start position in the forward movement of the carriage in accordance with the printing position control parameter i is dislocated from the desired position P1 to the right by one dot pulse, to be equal to a position P2, whereas the printing end position in the backward movement in accordance with the parameter m is dislocated to the left by one dot pulse, to be equal to a position P3. Thus, a dislocation corresponding to two dot pulses appears between the printing positions P2 and P3 (see FIG. 6(*d*)). Further, the printing end position in the forward movement in accordance with the parameter i is dislocated to the right by one dot pulse, to be equal to a position Q2, and the printing start position in the backward movement in accordance with the parameter k is dislocated to the left by one dot pulse, to be equal to a position Q3, with a dislocation of two dot pulses found between the printing positions Q2 and Q3 (see FIG. 6(*d*)).

In this manner, if the dot pulse to be counted is not counted due to the presence of a closed generation timing relation between the trailing edge of the home position sensor output and the detection edge of the dot pulse, a dislocation corresponding to two dot pulses occurs between adjacent printing lines respectively associated with the forward and backward movements. Such misalignment of the adjacent printing lines resulting from the above-mentioned dislocation makes the resultant printed text poor in quality.

Conventionally, to obviate this, fine adjustment of mounting position of the home position sensor is made upon assemblage of the printer. However, such adjustment requires labor. Further, the mounting position of the home position sensor varies with a change in temperature around the printer and due to the presence of deterioration with age and wear of associated parts of the printer. Thus it is difficult to prevent dislocation of printing position for a long service life of the printer.

SUMMARY OF THE INVENTION

The object of the present invention is to provide a method of controlling printing positions in a printer such as a serial printer adapted for bi-directional printing, which method is capable of positively preventing or reducing dislocation of printing positions for a long service life of the printer even if the printer is operated at various temperatures, without the need for effecting a fine adjustment of mounting position of a hoe position sensor, and to provide an apparatus therefor.

According to one aspect of the present invention, a method of controlling printing positions in a printer is provided, which comprises the steps of: (a) generating a series of dot pulses in synchronism with movement of a carriage on which a printing head is mounted; (b) generating a reference signal when the carriage reaches its reference moving positions; (c) detecting a predetermined edge of each of the dot pulses; (d) measuring a time period from an instant at which the reference signal is generated to an instant at which the predetermined edge of a dot pulse, which is generated for the first time after generation of the reference signal, is detected; (e) inverting detection polarity of the predetermined edge when a predetermined condition, associated with the time period mentioned in the step (d), is fulfilled; and (f) counting the predetermined edges of the dot pulses generated after the generation of the reference signal, and controlling the printing positions on the basis of the resultant count.

According to another aspect of the present invention, an apparatus for controlling printing positions in a printer is provided, which comprises: a carriage driving mechanism for moving a carriage on which a printing head is mounted; a dot pulse generator for generating a series of dot pulses in synchronism with movement of the carriage; a home position sensor for generating a reference signal when the carriage reaches its reference moving position; means for detecting a predetermined edge of each of the dot pulses; a timer means for measuring a time period from an instant at which the reference signal is generated to an instant at which the predetermined edge of a dot pulse, which is generated for the first time after generation of the reference signal, is detected; a discrimination means for determining whether or not a predetermined condition associated with the just-mentioned time period is fulfilled; means for inverting detection polarity of the predetermined edge when the predetermined condition is fulfilled; and a control means for counting the predetermined edge of the dot pulses generated after generation of the reference signal and controlling the printing positions on the basis of the resultant count.

DETAILED DESCRIPTION

In the following, a serial dot printer of a type capable of effecting bi-directional printing, which is equipped with a printing position controller according to an embodiment of the present invention, will be explained.

Figure 3:
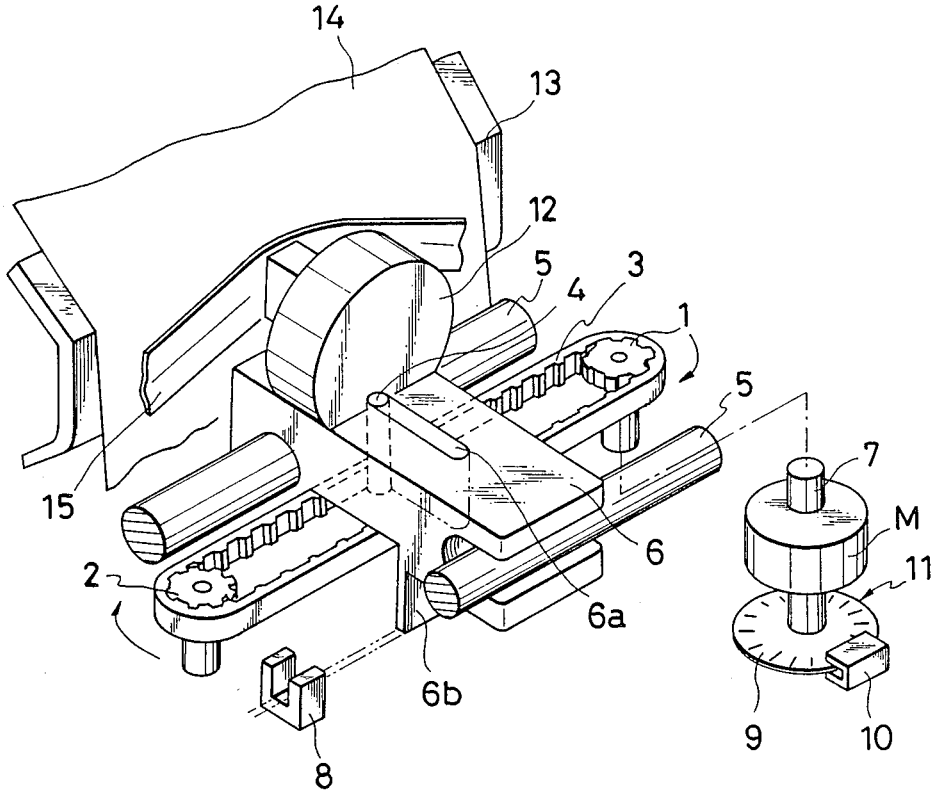
FIG. 3 is a fragmentary perspective view showing a serial printer on which the control section of FIG. 2 is mounted.

Referring to FIG. 3, the printer comprises an endless timing belt 3, which is stretched between a driving gear 1 fixed on an output shaft 7 of a carriage driving motor M and a driven gear 2 rotatably supported by a printer body (not shown). A pin 4 for operatively connecting the timing belt 3 with a carriage 6 is fixed on an outer periphery of the belt 3 so as to be movable in unison therewith, and extends vertically in the printer. The pin 4 has its distal end fitted in an elongated hole **6*a* formed in a central position of the carriage 6 which is disposed for slidable movement along a pair of carriage guide rods 5, and which has its bottom portion to which a shield plate 6*b* is fixed in a manner movable in unison therewith. A home position sensor 8, comprised of a photosensor, for instance, is disposed at a location facing a path along which the shield plate 6 moves, and is arranged to detect the carriage 6 through the shield plate 6 when the carriage reaches its leftmost moving position. Operatively coupled to the motor shaft 7 is a dot pulse generator 11 for generating a dot pulse, indicative of the printing position, each time the motor M rotates for a predetermined rotational angle. The pulse generator 11 comprises a disc 9 disposed for rotation in unison with the motor shaft 7 and formed with radial slits, and a photosensor 10 disposed in facing relation to the disc 9. Reference numeral 12 denotes a printing head fixed on the carriage 6; 13, a platen for guiding a print sheet 14; and 15**, a printing ribbon.

Figure 2:
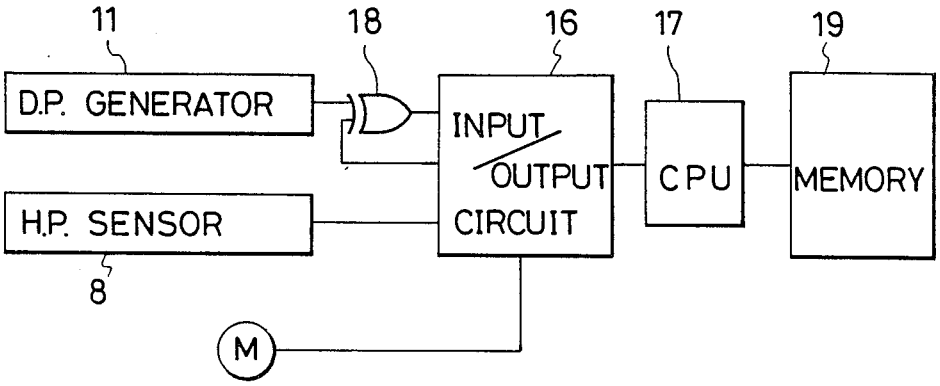
FIG. 2 is a schematic block diagram showing a printer control section for embodying the printing position control method.

Referring to FIG. 2, the home position sensor 8 is connected to a microprocessor (hereinafter referred to as CPU) 17 through an input/output circuit 16, and the pulse generator 11 is connected to one input terminal of an exclusive OR circuit (hereinafter referred to as XOR) 18 having another input terminal connected to one output terminal of the input/output circuit 16 through which a signal, supplied from the CPU 17 for selectively inverting a level of an output of the dot pulse generator 11, is delivered to the XOR 18 after amplification in the circuit 16, the same generator output being utilized for printing position control. Further, a memory 19 is connected to the CPU 17, which is comprised of a ROM storing therein a control program to be executed by the CPU 17 or the like and a RAM adapted to temporarily store results of arithmetic operation by the CPU 17 or the like. The motor M is connected through the input/output circuit 16 to the CPU 17 in control relation.

In the following, the operation of the printer constructed as mentioned above will be explained.

Figure 1A:
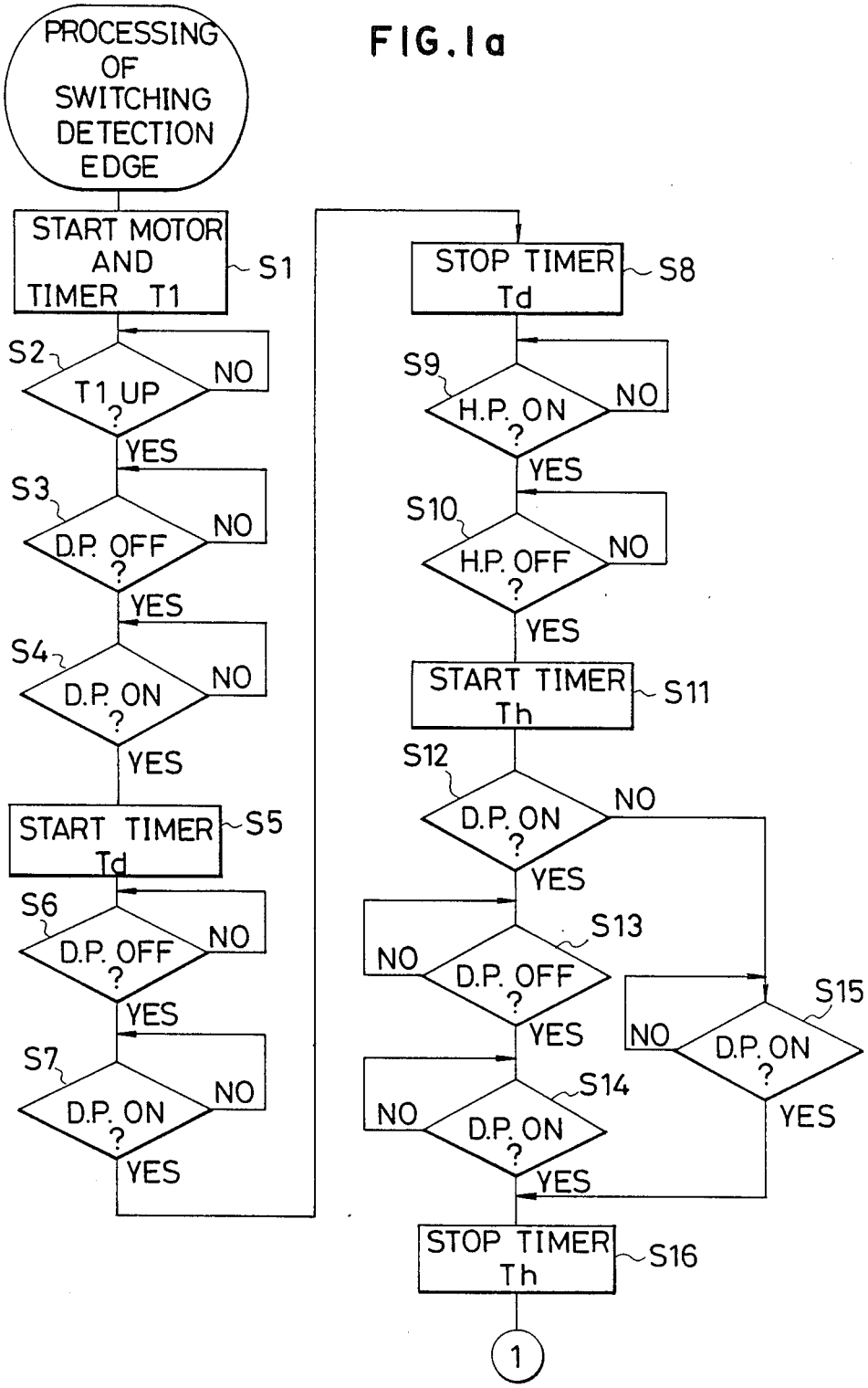
FIG. 1 is a flowchart showing an operation of selectively inverting a dot pulse generator output effected in a printing position control method according to an embodiment of the present invention.
Figure 1B:
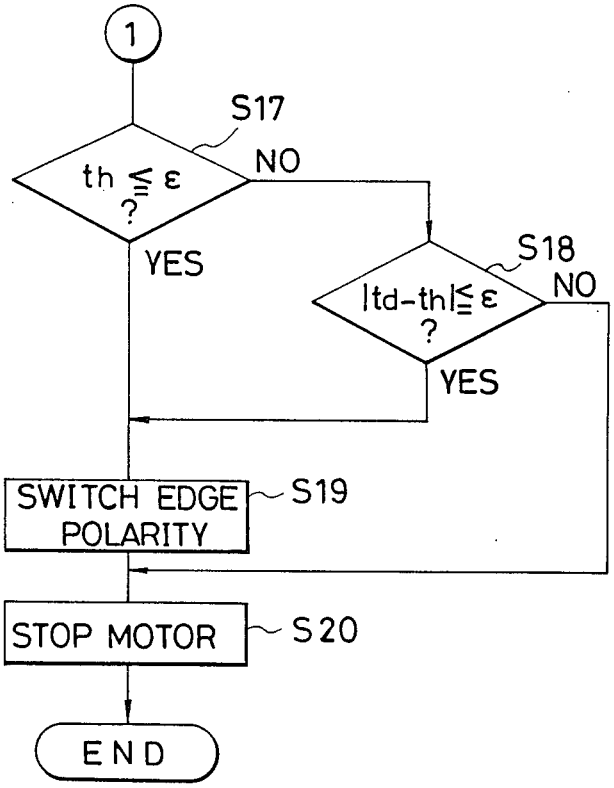

Upon supply of electric power to the printer, an operation (FIG. 1) of selectively inverting the polarity of a detection edge of the dot pulses for printing position control is executed prior to an ordinary printing operation, as distinct from conventional printers.

In this selective inversion operation, the CPU 17 drives the carriage driving motor M and at the same time starts a timer T1, comprised of a software timer, for which a time period is set beforehand (the step S1), the time period, which starts at an instant at which the motor starts, being set to a value which permits the motor M to reach a stationary state where the motor rotates at a constant speed. With rotation of the motor M, the carriage 6 is moved through the driving gear 1, the timing belt 3 and the pin 4 along the pair of carriage guide rods 5 from its initial or start position to its leftmost moving position, and then, from the leftmost moving position to a rightmost moving position, for instance. At the same time an output, comprised of a series of dot pulses, is delivered from the dot pulse generator 11. In the meantime, the pin 4 slides in the elongated hole **6*a* of the carriage 6** when the moving direction of the carriage is reversed.

Subsequent to the step S1, the CPU 17 determines whether or not the time T1 is up (the step S2). If it is determined that the timer T1 is up and hence the above-mentioned stationary state of the motor M is reached, the CPU 17 executes processing, mentioned hereinbelow, where one period of the dot pulse generator output and a time period, from an instant at which the trailing edge of the home position sensor output is generated to an instant the leading edge of a dot pulse following the trailing edge of the sensor output is generated, are respectively detected, so as to make a determination as to whether or not the leading edge of the dot pulse, serving as the detection edge for printing position control, and the trailing edge of the home position sensor output are in a closed generation timing relation to each other.

That is, the CPU 17 determines whether or not the output signal from the dot pulse generator 11 is in a low level or in an OFF state (the step S3), and, if the result of this determination is negative, the CPU waits until the same output is rendered OFF. On the other hand, if the determination result is affirmative, the program advances to the step S4 where a determination is made as to whether or not the pulse generator output is in a high level or in an ON state. If the result of the determination at the step S4 is negative, the CPU 17 waits until the same output is rendered ON. On the other hand, if the determination result is affirmative, i.e., if the leading edge of the dot pulse concerned is detected, the CPU 17 causes a timer Td, comprised of a software timer, for instance, for measuring one period of the pulse generator output, to start (the step S5).

Thereafter, the CPU 17 waits until the pulse generator output is off (the step S6), and further waits until the generator output is rendered ON again (the step S7). If it is determined that the output of the pulse generator 11 is ON at the step S7, the CPU 17 causes the timer Td to stop (the step S8). As a result, a value td indicative of one cycle of the generator output is recorded in this timer Td.

During the execution of the steps S1 through S8 and after that, the carriage 6 is moved from its start position to its leftmost moving position, and is then moved from the leftmost moving position to the rightmost moving position. During the leftward movement of the carriage 6, the home position sensor output is OFF is the carriage 6 does not reach a location at or near its leftmost moving position, i.e., if the shield plate 6*b* does not each at a location facing the home position sensor 8. Thereafter, when the carriage 6 reaches the location at or in the vicinity of its leftmost moving position, the shield plate 6*b* is detected by the home position sensor 8, so that the sensor output is ON. Further, after inversion of the moving direction of the carriage 6, the sensor output is switched from an ON state to an OFF state when the shield plate 6*b* is moved away from the sensor 8, i.e., when the carriage 6 assumes its reference moving position.

During the movement of the carriage 6, to detect the time period from an instant at which the trailing edge of the home position sensor output is generated to an instant at which the leading edge of the dot pulse, generated immediately after generation of the trailing edge of the sensor output, is generated, the CPU 17 waits until the sensor output is rendered ON, at the step S9, and then determines whether or not the sensor output is OFF (the step S10). If it is determined that the sensor output is OFF, the CPU 17 causes the timer Th to start for measuring a time interval between the above-mentioned two edges (the step S11).

Figure 4:
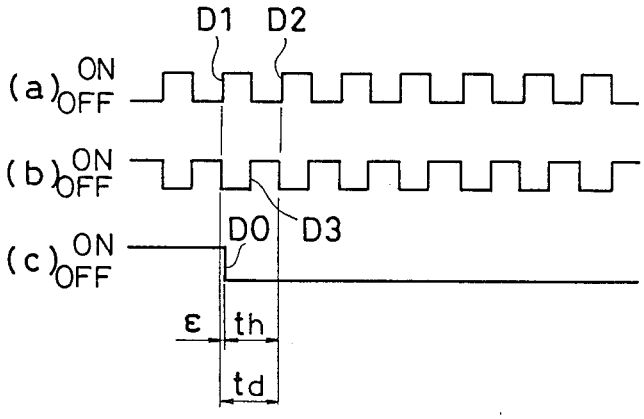
FIG. 4 is a waveform diagram showing a relationship between a dot pulse generator output and a home position sensor output.
Figure 5:
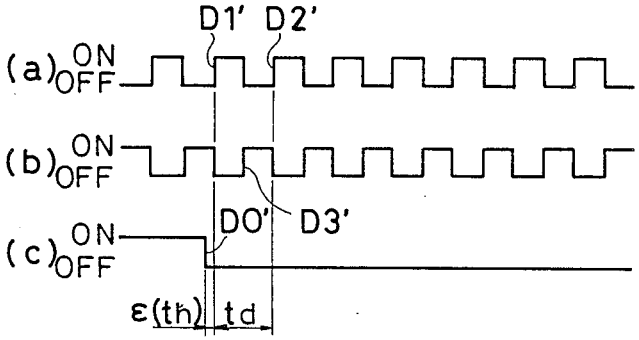
FIG. 5 is a diagram, similar to FIG. 4, showing another relationship.
Figure 6:
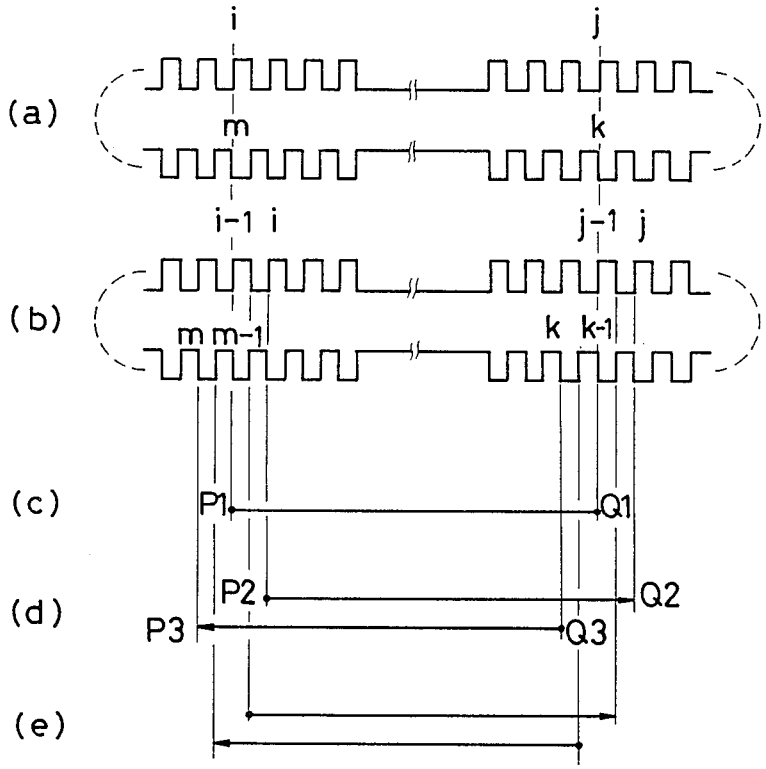
FIG. 6 is a view explaining operational principle of the prior art arrangement and that of the printer of FIGS. 2 and 3.

In order to determine whether or not one of the relationships respectively shown in FIGS. 4(*a*), (*c*) and FIGS. 5(*a*), (*c*) between the pulse generator output and the home position sensor output is established, the CPU 17 makes a determination as to whether or not the output of the dot pulse generator 11 is at a high level (ON) immediately after the start of the timer Th (the step S12). If the generator output is ON, as shown in FIG. 4, the CPU 17 executes the steps S13 and S14 corresponding to the above-mentioned steps S3 and S4, so as to detect the leading edge of the dot pulse which is generated for the first time after the fall of the output of the home position sensor 8. On the other hand, if it is determined at the step S12 that the pulse generator output is OFF (see FIG. 5), the CPU 17 waits until the dot pulse concerned is generated (the step S15). After detection of the trailing edge of the home position sensor output, when the leading edge of the dot pulse is detected at the step S14 or S15, the CPU 17 causes the tier Th to stop (the step S16). As a result, the time period th from an instant at which the trailing edge of the home position sensor output is detected to an instant at which the leading edge of the dot pulse, which is generated for the first time after the detection of the trailing edge of the sensor output, is detected is recorded in this timer Th.

Next, in order to determine whether or not the generation timing of the trailing edge of the sensor output and that of the leading edge of the dot pulse are very close to each other in case that one of the relationships shown in FIGS. 5 and 4 is established between these edges, the CPU 17 compares the above-mentioned time period th with a minute value $\epsilon$ which is set beforehand so as to be close to "0"in magnitude, to determine whether or not the time period th is equal to or less than the set value $\epsilon$ (the step S17). Further, if the result of determination at the step S17 is negative, the CPU 17 determines whether or not the absolute value of the difference between the dot pulse period td and the time period th is equal to or less than the set value $\epsilon$ (the step S18). Then, if either one of the results of the determinations at the steps S17 and S18 is positive, i.e., if the trailing edge of the home position sensor output and the leading edge of the dot pulse concerned are in a closed timing relation to each other, the CPU 17 executes at the step S19 an operation of inverting the polarity of the detection edge of the dot pulses. More specifically, the CPU 17 sets an edge switching signal at its high level, the signal being supplied from the CPU 17 to the XOR 18 through the input/output circuit 16. As a result, the level of the output of the dot pulse generator 11 is inverted by the XOR 18, so that the leading edge of each of the dot pulses is detected, with a phase shift or a time lag of one-half period of the dot pulses. On the other hand, if both the results of the determination at the steps S17 and S18 are negative, i.e., if no closed timing relation is found between the trailing edge of the sensor output and the leading edge of the dot pulse, a malfunction in counting the dot pulses hardly occurs, and thus the CPU 17 sets the edge switching signal at its low level so as to render the same signal ineffective, so that the dot pulse generator output is not subjected to the inversion operation.

After effecting the inversion operation of the pulse generator output, where required, the CPU 17 causes the carriage driving motor M to stop (the step S20), and the completes the execution of the program.

In an ordinary printing operation, the printer operates to count each of the dot pulses supplied from the dot pulse generator 11 after the fall of the output of the home position sensor 8, and, on the basis of this count, it controls printing positions for each printing line. On this occasion, if the relationship $|td-th| \leqq \epsilon$ shown in FIGS. 4(*a*) and (*c*) or the relationship $td \leqq \epsilon$ shown in FIGS. 5(*a*) and (*c*) is established between the sensor output and the pulse generator output, in the prior art arrangement, a fluctuation in the generation timing of the leading edge D1, D1' of the dot pulse occurs with respect to the generation timing of the trailing edge D0, D0' of the sensor output due to the reasons such as vibration of the carriage driving mechanism, as mentioned above, so that the leading edge of the dot pulse to be detected cannot be detected, resulting in a dislocation of printing positions corresponding to two dot pulses between adjacent printing lines when bi-directional printing is carried out. On the contrary, according to the present embodiment, the pulse generator output is inverted so that it is delayed by one-half period thereof, so that dot pulse counting operation is started from the leading edge D3, D3' of the dot pulse concerned, if either one of the above-mentioned two relationships is established. As a result, the interval between the trailing edge D0, D0' of the sensor output and the leading edge D3, D3' of the dot pulse, i.e., a counting error, is reduced to a value less than one-half period of the pulse generator output, whereby a dislocation between adjacent printing lines during bi-directional printing is reduced less than an amount corresponding to one dot pulse.

In the above-mentioned embodiment, one period of the dot pulse generator output is measured by the use of the timer Td each time electric power is turned on so as to positively measure the same period. However, it may be possible to employ a value which is stored beforehand in a memory and is indicative of one period of pulse generator output when the carriage driving motor is driven in its stationary state. Although the ratio of an ON time period of the pulse generator output to an OFF time period thereof is set to 1:1 in the embodiment, it may be possible to set these periods in such a manner that one of them is not considerably smaller in magnitude than the other. Further, in the above-mentioned embodiment, the home position sensor is so arranged that the output of the sensor falls upon the carriage reaching its reference moving position, a sensor of a type whose output rises at the time may be employed. Moreover, instead of the leading edge of the dot pulse serving as the detection edge for printing position control, the trailing edge of the dot pulse may be used. In the above-mentioned embodiment, the pulse generator output is inverted so as to shift the phase of the detection edge, the present invention is not limited thereto.

What is claimed is:

1. A method of controlling printing positions in a printer, comprising the steps of:

(a) generating a series of dot pulses in synchronism with movement of a carriage on which a printing head is mounted;

(b) generating a reference signal when the carriage reaches its reference moving position;

(c) detecting a predetermined edge of each of the dot pulses;

(d) measuring a time period from an instant at which the reference signal is generated to an instant at which the predetermined edge of a dot pulse, which is generated for the first time after generation of the reference signal, is detected;

(e) establishing that a first predetermined condition is fulfilled when the measured time period is less than a first predetermined set value and establishing that a second predetermined condition is fulfilled when a difference between one period of said series of dot pulses and the measured time period is less than a second predetermined set value;

(f) inverting detection polarity of the predetermined edge when any of said first and second predetermined conditions are fulfilled; and (g) counting the predetermined edges of the dot pulses generated after the generation of the reference signal, and controlling the printing positions on the basis of the resultant count.

2. A method according to claim 1, wherein each of said dot pulses is inverted in its level in said step (d) so as to effect a phase shift of the predetermined edge thereof.

3. A method according to claim 1, further including: a step of measuring one period of said series of dot pulses.

4. A method according to claim 1, further including: a step of measuring one period of said series of dot pulses;

wherein said second predetermined condition is fulfilled when a difference between the thus measured one period of said series of dot pulses and said time period is less than said second set value.

5. A method according to claim 1, wherein said first and second set values are set to be equal to each other.

6. A method according to claim 1, wherein said printer includes a carriage driving motor, and, in said step (a), each of said series of dot pulses is generated each time said motor rotates for a predetermined rotational angle.

7. A method according to claim 1, wherein said predetermined edge of each of said dot pulses is comprised of either one of leading and trailing edges of said dot pulse.

8. A method according to claim 1, wherein said printer is a serial printer capable of effecting bi-directional printing.

9. A method according to claim 1, wherein said first and second set values are set to minute values corresponding to a closed timing relationship between the generation of said reference signal and the detection of said predetermined edge mentioned in said step (d), said predetermined edge being undetectable if said closed timing relationship is established.

10. An apparatus for controlling printing positions in a printer, comprising:

a carriage driving mechanism for moving a carriage on which a printing head is mounted;

a dot pulse generator for generating a series of dot pulses in synchronism with movement of the carriage;

a home position sensor for generating a reference signal when the carriage reaches its reference moving position;

means for detecting a predetermined edge of each of the dot pulses;

a timer means for measuring a time period from an instant at which the reference signal is generated to an instant at which the predetermined edge of a dot pulse, which is generated for the first time after generation of the reference signal, is detected;

a discrimination means for determining whether or not any of first and second predetermined conditions are fulfilled, said first predetermined condition being fulfilled when a time period measured by said timer means is less than a first predetermined set value and said second predetermined condition being fulfilled when a difference between one period of said series of dot pulses and the time period measured by said timer means is less than a second predetermined set value;

means for inverting detection polarity of the predetermined edge when any of said first and second predetermined conditions are fulfilled; and a control means for counting the predetermined edge of the dot pulses generated after the generation of the reference signal and controlling the printing positions on the basis of the resultant count.

11. An apparatus according to claim 10, wherein said detection polarity inverting means includes means for generating a signal having its level varying in dependence on the result of determination effected by said discriminating means, and an exclusive OR circuit for receiving the signal supplied from said signal generating means and the output of said dot pulse generator, said detecting polarity inverting means being operable to invert polarity of said predetermined edge of the dot pulses.

12. An apparatus according to claim 10, further including: a second timer means for measuring one period of an output of said dot pulse generator.

13. An apparatus according to claim 11, further including: a second timer means for measuring one period of an output of said dot pulse generator;

wherein said discriminating means determines that said second predetermined condition is fulfilled when a difference between the one period of the dot pulse generator output measured by said second timer means and said time period is less than said second set value.

14. An apparatus according to claim 10, wherein said first and second set values are set to be equal to each other.

15. An apparatus according to claim 10, wherein said printer includes a carriage driving motor, and said dot pulse generator operates to generate each of the dot pulses each time said motor rotates for a predetermined rotational angle.

16. An apparatus according to claim 10, wherein said predetermined edge of each of said dot pulses is comprised of either one of leading and trailing edges of said dot pulse.

17. An apparatus according to claim 10, wherein said printer is a serial printer capable of effecting bi-directional printing.

* * * * *